US009631575B2

(12) United States Patent
Gibson et al.

(10) Patent No.: US 9,631,575 B2
(45) Date of Patent: Apr. 25, 2017

(54) METHODS AND SYSTEMS FOR IMPROVING ENGINE STARTING

(71) Applicant: Ford Global Technologies, LLC, Dearborn, MI (US)

(72) Inventors: Alex O'Connor Gibson, Ann Arbor, MI (US); Brad Alan VanDerWege, Plymouth, MI (US); David Oshinsky, Trenton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 931 days.

(21) Appl. No.: 13/945,651

(22) Filed: Jul. 18, 2013

(65) Prior Publication Data

US 2015/0025780 A1 Jan. 22, 2015

(51) Int. Cl.

| | |
|---|---|
| ***F02N 11/08*** | (2006.01) |
| ***F02D 43/00*** | (2006.01) |
| ***F02D 41/06*** | (2006.01) |
| *F02N 19/00* | (2010.01) |
| *F02D 41/04* | (2006.01) |
| *F02D 41/00* | (2006.01) |

(52) U.S. Cl.

CPC ..... *F02D 43/00* (2013.01); *F02D 41/065* (2013.01); *F02N 11/0803* (2013.01); *F02D 41/003* (2013.01); *F02D 41/042* (2013.01); *F02D 2041/0095* (2013.01); *F02D 2200/0611* (2013.01); *F02N 11/0814* (2013.01); *F02N 2019/002* (2013.01)

(58) Field of Classification Search

CPC .. F02N 11/08; F02N 11/0803; F02N 11/0814; F02D 2013/0292; F02D 33/006; F02D 41/06; F02D 41/061; F02D 41/062; F02D 41/065; F02D 41/3076; F01L 2800/01

See application file for complete search history.

(56) References Cited

U.S. PATENT DOCUMENTS

| | | | | |
|---|---|---|---|---|
| 7,051,693 | B2 | 5/2006 | Tetsuno et al. | |
| 7,377,248 | B2 | 5/2008 | Hokuto | |
| 7,441,541 | B2 | 10/2008 | Nakamura et al. | |
| 7,562,650 | B2 | 7/2009 | Tabata et al. | |
| 7,587,270 | B2 | 9/2009 | Tabata et al. | |
| 2001/0008134 | A1* | 7/2001 | Hasegawa | F02D 41/047 123/491 |
| 2005/0205037 | A1* | 9/2005 | Lewis | B60W 10/06 123/179.16 |
| 2006/0254564 | A1* | 11/2006 | Lewis | F01L 9/04 123/491 |
| 2007/0056546 | A1* | 3/2007 | Trask | F01L 9/04 123/179.18 |

(Continued)

FOREIGN PATENT DOCUMENTS

WO 2006062250 A1 6/2006

*Primary Examiner* — Erick Solis
*Assistant Examiner* — Anthony L Bacon
(74) *Attorney, Agent, or Firm* — Julia Voutyras; McCoy Russell LLP

(57) ABSTRACT

Systems and methods for restarting an engine are presented. In one example, fuel is injected to cylinder ports before the engine is stopped such that the injected fuel is not inducted into the cylinders before an engine restart is requested. The method may improve fuel vaporization during engine restarting.

18 Claims, 4 Drawing Sheets

(56) References Cited

U.S. PATENT DOCUMENTS

| | | | | |
|---|---|---|---|---|
| 2007/0234984 | A1* | 10/2007 | Kolmanovsky | F01L 9/04 123/90.15 |
| 2007/0235005 | A1* | 10/2007 | Lewis | F01L 9/04 123/322 |
| 2009/0101115 | A1* | 4/2009 | Murase | F01L 1/34 123/491 |
| 2011/0203552 | A1* | 8/2011 | Aso | F02D 41/0025 123/443 |
| 2012/0022765 | A1* | 1/2012 | Tsuji | F02D 41/008 701/103 |

* cited by examiner

METHODS AND SYSTEMS FOR IMPROVING ENGINE STARTING

FIELD

The present description relates to a system and methods for improving engine starting. The methods may be particularly useful for engines that operate with fuels that may vary in alcohol content.

BACKGROUND AND SUMMARY

An engine of a vehicle may be automatically stopped during vehicle operation to conserve fuel. The engine may also be automatically restarted in response to operating conditions. If a driver depresses an accelerator pedal or applies another device to command a vehicle to move, it may be desirable to restart engine quickly so that the vehicle and engine may comply with the driver's request. If the vehicle and engine do not comply with the driver's request in a timely manner, the driver may be dissatisfied with the vehicle's response. One way to improve engine and vehicle response to the driver's request is to inject fuel to engine cylinders when an intake valve of the cylinder receiving fuel is open so that the engine may be started in a shorter time period. However, open valve fuel injection may allow fuel to impinge on cylinder walls and enter the engine crankcase or reduce the oil film on cylinder walls.

The inventors herein have recognized the above-mentioned disadvantages and have developed a method for operating an engine, comprising: ceasing combustion in engine cylinders; port injecting fuel to a first cylinder while the engine is rotating and intake valves of the first cylinder are closed; stopping the engine without inducting the port injected fuel into the first cylinder; and combusting the port injected fuel in the first cylinder after port injecting fuel to a second cylinder while intake valves of the second cylinder are open.

By port injecting fuel to cylinders having closed intake valves during engine stopping, it may be possible to improve fuel vaporization for engine cylinders that are not provided fuel during open valve conditions for a first engine cycle since engine stop. For example, fuel may be injected before engine stop to a first group of engine cylinders that have closed intake valves near the end of engine shutdown (e.g., a time from an engine stop request to actual engine stop) and during engine stop. Injecting fuel to a closed intake valve may improve the possibility of vaporizing the port injected fuel as an amount of time the fuel is in contact with a warm engine intake valve or cylinder intake port increases. After a request to restart the engine, fuel may be port injected to a second group of cylinders that have open intake valves to reduce engine starting time. Fuel that was injected to a closed intake valve as the engine neared a stopped state may be drawn into cylinders in a vaporized state as the engine rotates and the intake valves open.

Thus, a portion of engine cylinders may receive open valve injected fuel during a first cylinder cycle since engine stop while another portion of engine cylinders induct fuel that was injected to a closed intake valve during engine stopping. In this way, the engine may be quickly started via open valve injection, and engine emissions and combustion stability may be improved via closed valve injection. Further, since less than all engine cylinders receive open valve injection during engine restarting, the amount of fuel that encounters cylinder walls and enters the engine crankcase may be reduced.

The present description may provide several advantages. Specifically, the approach may improve engine emissions and combustion stability during engine starting. Further, the approach may improve engine starting when fuels having higher concentrations of alcohol are injected to the engine. Further still, the approach may reduce the possibility of engine degradation by reducing the amount of liquid fuel that enters engine cylinders.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
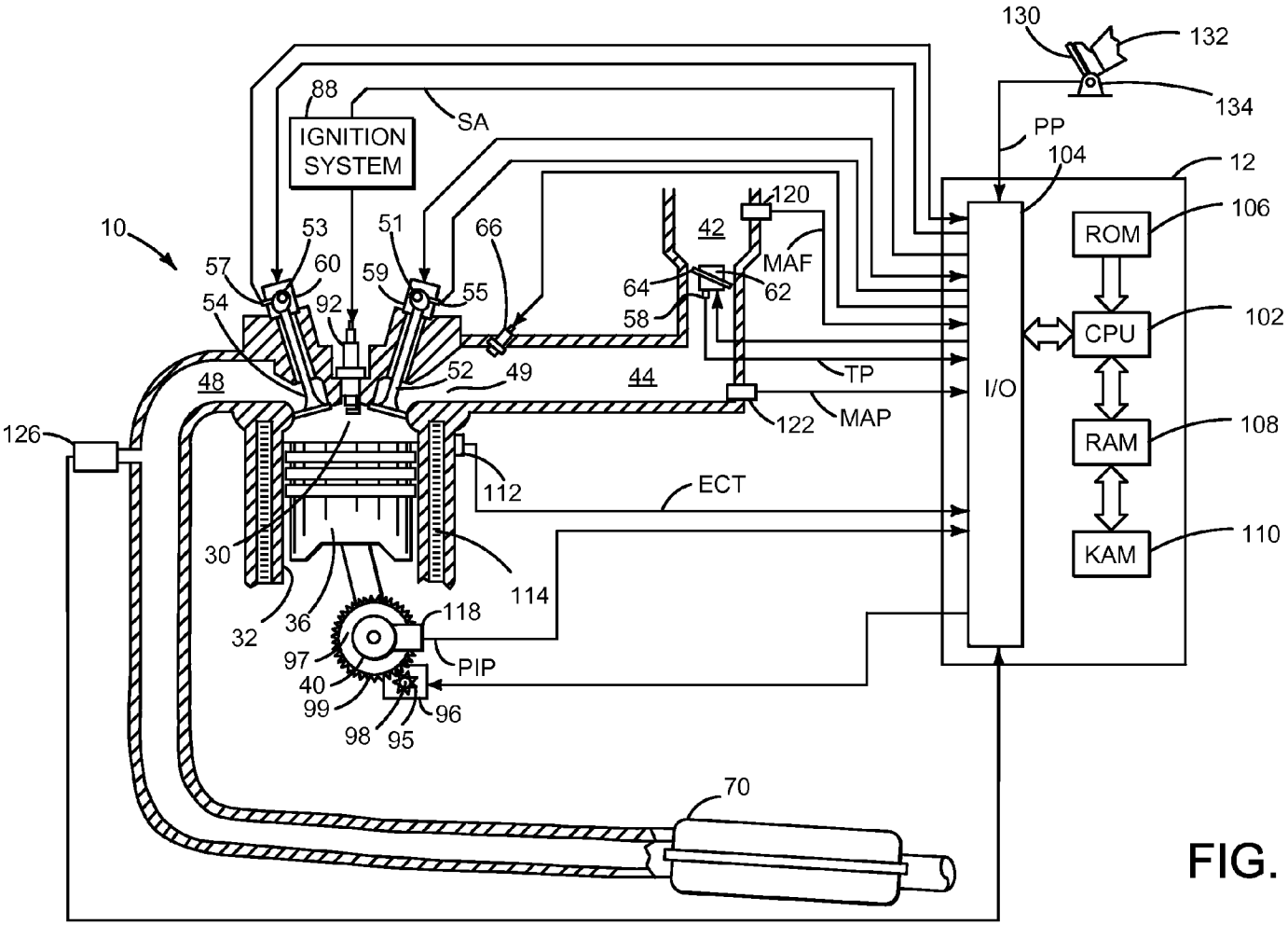
FIG. 1 is a schematic diagram of an engine.
Figure 2:
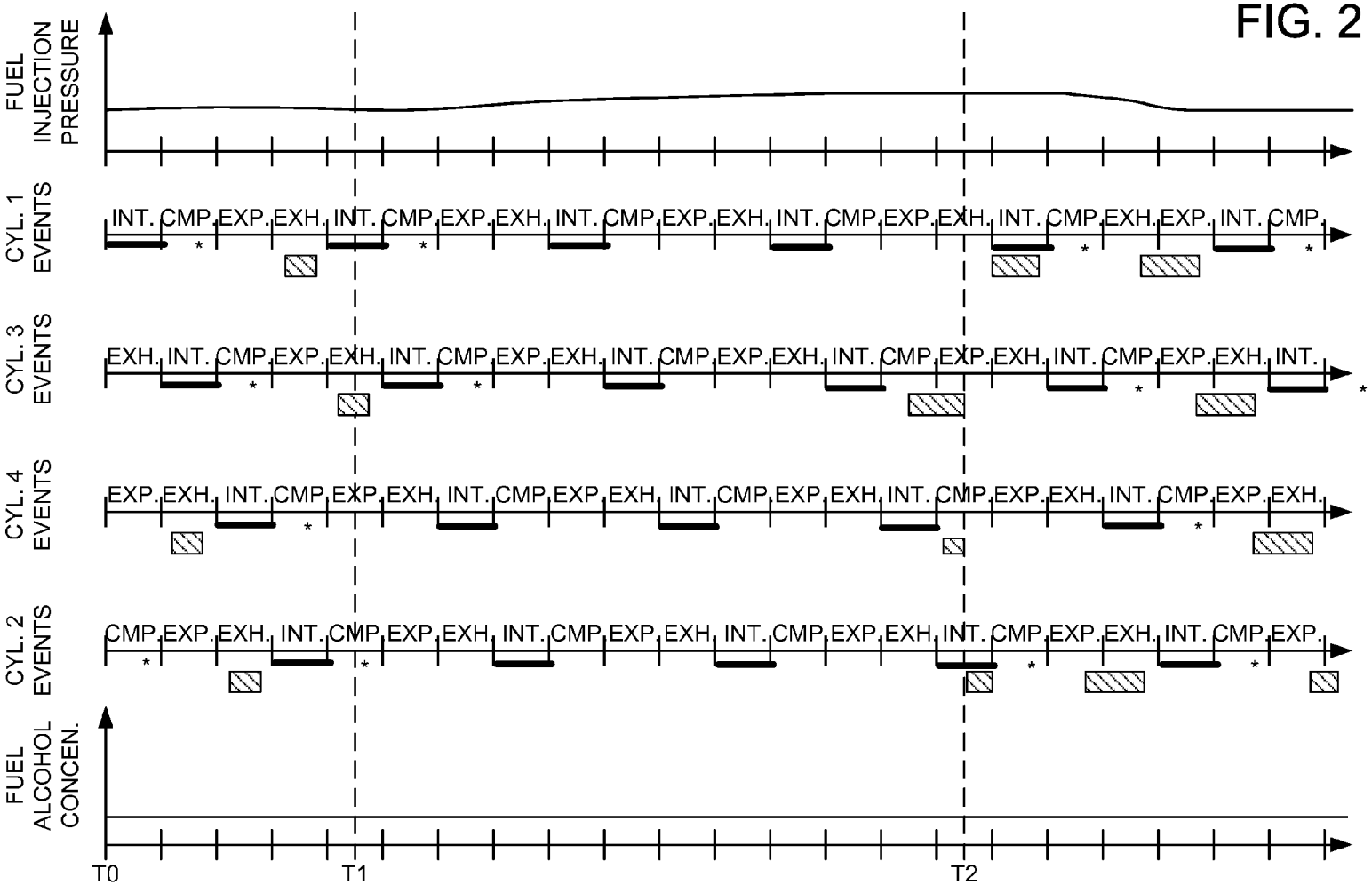
FIG. 2 is a prophetic example of a first engine stop and start.
Figure 3:
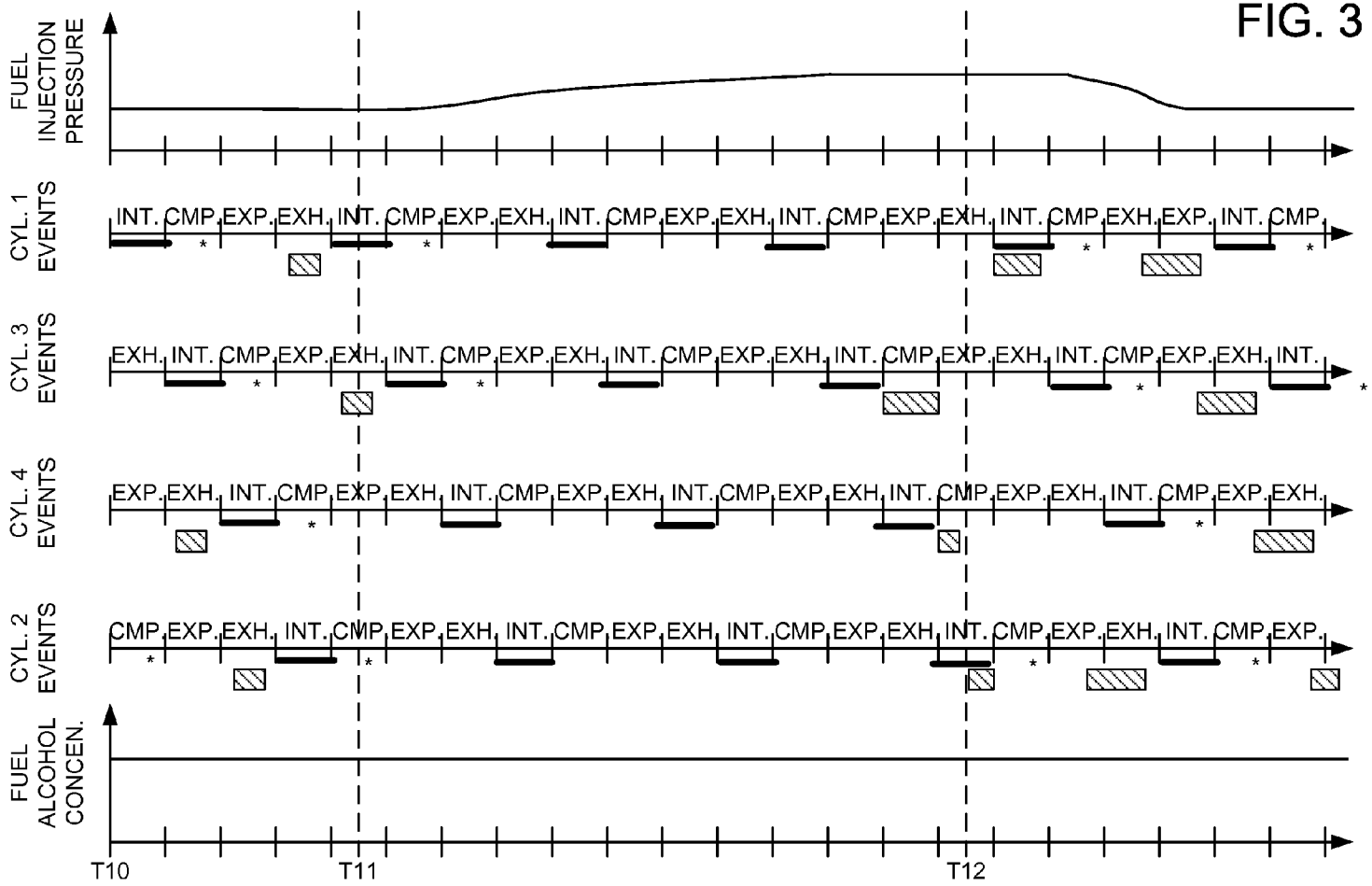
FIG. 3 is a prophetic example of a second engine stop and start.
Figure 4:
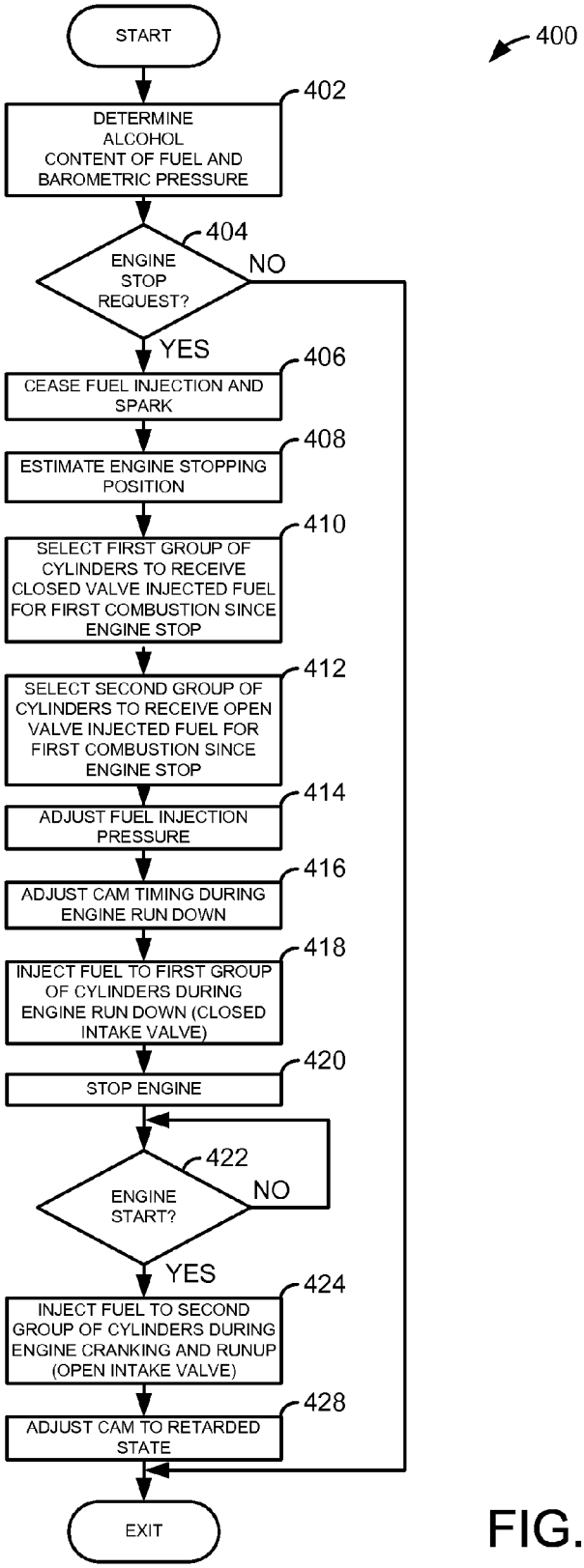
FIG. 4 is a flowchart showing one example method for operating an engine.

The present description is related to controlling engine stopping and starting. The engine may be automatically stopped and started based on vehicle conditions. FIG. 1 shows an example engine that may be automatically stopped and started. FIGS. 2 and 3 show example engine stopping and starting sequences according to the method of FIG. 4. A method for adjusting engine actuators during engine stopping and starting is shown in FIG. 4.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake cam 51 and exhaust cam 53 may be moved relative to crankshaft 40 via variable intake cam actuator 59 and variable exhaust cam actuator 60.

Fuel injector 66 is shown positioned to inject fuel directly into cylinder intake port 49, which is known to those skilled in the art as port fuel injection. Fuel injector 66 delivers liquid fuel in proportion to the pulse width of signal from controller 12. Fuel is delivered to fuel injector 66 by a fuel system (not shown) including a fuel tank, fuel pump, and fuel rail (not shown). In addition, intake manifold 44 is shown communicating with optional electronic throttle 62 which adjusts a position of throttle plate 64 to control air flow from air intake 42 to intake manifold 44. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Thus, the system of FIG. 1 provides for a vehicle system, comprising: an engine including first and second groups of cylinders and an adjustable intake valve system; and a controller including non-transitory instructions executable to cease combustion in the first and second groups of cylinders during an engine stop, port injecting fuel to closed intake valves of the first cylinder group before the engine stop, and to perform a first combustion event in a cylinder of the second cylinder group in response to an engine start, where fuel is port injected to open intake valves of the second cylinder group. The vehicle system further comprises additional instructions executable to increase fuel pressure in response to a request to stop the engine.

In some examples, the vehicle system further comprises additional instructions executable to increase fuel pressure in response to an alcohol content of fuel supplied to the engine. The vehicle system further comprises additional instructions to advance intake valve timing in response to a request to stop the engine. The vehicle system includes where the first group of cylinders is one half a total number of engine cylinders. The vehicle system further comprises additional instructions to estimate an engine stopping position.

FIG. 2 is a prophetic first example engine stop and start according to the method of FIG. 4. The first example shows engine stopping and starting for an engine that is supplied fuel with a low alcohol concentration. The operating sequence of FIG. 2 may be provided via the system of FIG. 1 executing instructions according to the method of FIG. 4 that are stored in non-transitory memory. Vertical markers T0-T2 represent times of particular interest during the sequence. All plots in FIG. 2 are referenced to the same X axis scale. The engine starting and stopping sequence is for a four cylinder four stroke engine having a firing order of 1-3-4-2.

The first plot from the top of FIG. 2 is a plot of fuel injection pressure verses engine position. The X axis represents engine position and engine position may be determined via the positions of cylinders 1-4 shown in the $2^{nd}$ through $5^{th}$ plots of FIG. 2. The vertical markers along the X axis represent top dead center or bottom dead center positions of different engine cylinders. The Y axis represents fuel injection pressure and fuel injection pressure increases in the direction of the Y axis arrow.

The second plot from the top of FIG. 2 is a plot of strokes for cylinder number one. Cylinder number one is on the stroke identified in the second plot as the engine rotates through strokes from the left hand side of FIG. 2 to the right hand side of FIG. 2. The strokes change according to strokes of a four stroke engine. INT. is the abbreviation for intake stroke, CMP. is the abbreviation for compression stroke, EXP. is the abbreviation for expansion stroke, and EXH. is the abbreviation for exhaust stroke. Intake valve opening time for the intake valves of cylinder number one is indicated by the heavy lines below the stroke labels for cylinder number one. Spark timing for cylinder number one is indicated by the * below the stroke labels. Fuel injection timing is indicated by the slashed bars below the stroke labels for cylinder number one. The vertical bars separate the different cylinder strokes and indicate the cylinder's piston is at bottom dead center or top dead center. For example, the vertical bar between intake stroke and compression stroke is bottom dead center intake or compression stroke.

The third plot from the top of FIG. 2 is a plot of strokes for cylinder number three. Cylinder number three is on the stroke identified in the third plot as the engine rotates through strokes from the left hand side of FIG. 2 to the right hand side of FIG. 2. Intake valve opening time for the intake valves of cylinder number three is indicated by the heavy lines below the stroke labels for cylinder number three. Spark timing for cylinder number three is indicated by the * below the stroke labels for cylinder number three. Fuel injection timing is indicated by the slashed bars below the stroke labels. The vertical bars separate the different cylinder strokes and indicate the cylinder's piston is at bottom dead center or top dead center.

The fourth plot from the top of FIG. 2 is a plot of strokes for cylinder number four. Cylinder number four is on the stroke identified in the fourth plot as the engine rotates through strokes from the left hand side of FIG. 2 to the right hand side of FIG. 2. Intake valve opening time for the intake valves of cylinder number four is indicated by the heavy lines below the stroke labels for cylinder number four. Spark timing for cylinder number four is indicated by the * below the stroke labels for cylinder number four. Fuel injection timing is indicated by the slashed bars below the stroke labels. The vertical bars separate the different cylinder strokes and indicate the cylinder's piston is at bottom dead center or top dead center.

The fifth plot from the top of FIG. 2 is a plot of strokes for cylinder number two. Cylinder number two is on the stroke identified in the fifth plot as the engine rotates through strokes from the left hand side of FIG. 2 to the right hand side of FIG. 2. Intake valve opening time for the intake valves of cylinder number two is indicated by the heavy lines below the stroke labels for cylinder number two. Spark timing for cylinder number two is indicated by the * below the stroke labels for cylinder number two. Fuel injection timing is indicated by the slashed bars below the stroke labels. The vertical bars separate the different cylinder strokes and indicate the cylinder's piston is at bottom dead center or top dead center.

The sixth plot from the top of FIG. 2 is a plot of fuel alcohol content verses engine position. The X axis represents engine position and engine position may be determined via the positions of cylinders 1-4 shown in the $2^{nd}$ through $5^{th}$ plots of FIG. 2. The vertical markers along the X axis represent top dead center or bottom dead center positions of different engine cylinders. The Y axis represents alcohol content in the fuel provided to the engine and alcohol content increases in the direction of the Y axis arrow. It should be noted that the time between cylinder strokes may vary as engine speed increases and decreases; however, the number of engine degrees between strokes is constant and fixed.

At T0, the engine is rotating and combusting an air fuel mixture. The fuel injection pressure is a middle level pressure and the fuel provided to the engine has a lower alcohol concentration. Cylinder number one is entering an intake stroke, cylinder number three is entering an exhaust stroke, cylinder number four is entering an expansion stroke, and cylinder number two is entering a compression stroke.

Between T0 and T1, the engine continues to rotate and the cylinders progress through the indicated strokes. Fuel injection occurs in each cylinder and is via a port fuel injector, and the timing for injecting fuel to each cylinder is before the intake valve of the cylinder receiving the fuel opens. Spark for the cylinder receiving fuel occurs during the compression stroke. In this example, the intake valve opening timing between T0 and T1 begins to open for each cylinder at top dead center intake stroke and closes after bottom dead center compression stroke.

At T1, a request to stop the engine is made (not shown). The request to stop the engine may be made via a driver operating a switch or via the controller determining conditions are desirable to automatically stop the engine. For example, if vehicle speed is zero, the vehicle brake is applied, and the driver demand torque is less than a threshold torque, the engine controller may determine that it is desirable to stop the engine. An engine stopping or shutdown procedure begins in response to the engine stop request.

Between T1 and T2 the engine is shutdown in response to the request to stop the engine. In particular, port injection of fuel to the cylinders is stopped. For cylinders, such as cylinder number three, where port fuel injection has started, the fuel injection that is started is completed. Spark is also stopped after fuel injection is stopped. Spark is provided to cylinders that have inducted a last fuel amount before engine stop so that substantially all injected and inducted fuel (e.g., greater than 85%) is combusted in engine cylinders before engine stop. The engine continues to rotate and engine speed (not shown) is reduced via engine friction and pumping losses.

The fuel injection pressure is increased after fuel injection to engine cylinders is stopped a first time since the engine stop request. By increasing fuel injection pressure, vaporization of fuel injected to closed intake valves near the engine stop position may be improved. In one example, a table or function includes empirically determined fuel injection pressures that are based on engine temperature and an amount of alcohol in the fuel supplied to the engine. The table outputs a desired fuel injection pressure and fuel pump output pressure is increased to the desired fuel injection pressure.

Engine controller 12 of FIG. 1 also estimates engine stopping position before engine stop (e.g., between T1 and T2). In one example, engine stopping position is estimated when engine speed is reduced to a threshold speed. Engine stopping position may be estimated based on the strokes of the respective cylinders at the time engine speed reaches the threshold speed. For example, a table or function with empirically determined engine stopping positions may be indexed via the stroke of cylinder number one at the time the engine reaches the threshold speed. The table or function then outputs an estimated engine stopping position. For example, the table or function may estimate the engine stopping position to be 90 crankshaft degrees after top dead center compression stroke of cylinder number one.

In other examples, engine stopping position may be estimated based on an engine friction model and engine position at a time when engine speed is reduced to a threshold speed. For example, the engine friction model estimates a number of engine crankshaft degrees of rotation from the time engine speed is reduced to the threshold speed until the engine stops rotating. The estimated number of crankshaft degrees are added to the engine position at the time the engine speed reaches the threshold speed to determine engine stopping position.

Engine cylinders expected to have closed intake valves at the time the engine stops rotating are determined from the estimated engine stopping position and intake cam timing. In one example, intake valve closing times, or alternatively intake valve opening times, may be determined for each cylinder based on a table of empirically determined intake valve opening times and cam position relative to a base cam position.

Fuel is injected to intake ports of at least a portion of cylinders with pistons expected to stop when the cylinder's intake valves are closed. Fuel may be injected to an intake port of a cylinder having a piston expected to stop after intake valves of the cylinder close for a last time before the expected engine stop. If the engine stops rotating before a desired amount of fuel is injected to a particular cylinder, the fuel injection may continue while the engine is stopped until the desired amount of fuel is injected.

In some examples such as the example shown in FIG. 2, fuel is injected to a predetermined number of engine cylinders having pistons expected to stop when the cylinder's intake valves are closed (e.g., half the number of engine cylinders). The remaining engine cylinders receive port injected fuel during intake strokes of the respective cylinders when intake valves are open, even if the engine stops with closed intake valves in more than half of the engine cylinders. Specifically, fuel injection is restarted after being stopped in cylinder number three. Fuel is injected to cylinder number three as the engine decelerates and while intake valves of cylinder number three are closed. The fuel injection to cylinder number three stops at T2. Fuel is injected to cylinder number four shortly after the intake valve of cylinder number four closes and before the engine stops at T2. Fuel is not injected to cylinder numbers one and two before the engine stops at T2. By injecting fuel to the ports of cylinder numbers three and four, the injected fuel has more time to vaporize so that it may be readily combusted during a subsequent engine restart. The fuel pressure remains at a higher level when the engine stops rotating at T2.

The engine may be stopped at T2 for seconds or longer depending on operating conditions. An engine restart (not shown) request is made while the engine is stopped at T2. The engine begins to rotate via a starter after the engine start request and fuel is injected to cylinder numbers two and one based on engine position and engine firing order. The fuel is injected to intake ports of cylinder numbers two and one while intake valves of cylinder numbers two and one are open. Thus, cylinder numbers two and one receive open valve port fuel injection. By supplying port injected fuel to open intake valves, the engine may start faster as cylinder numbers two and one are the first two cylinders to combust an air fuel mixture since engine stop at T2.

As the engine continues to rotate, fuel injected to intake ports of cylinder numbers three and four during engine shutdown is inducted and combusted without additional fuel injection to cylinder numbers three and four. However, if the engine stop time is greater than a threshold amount of time, additional fuel may be port injected to cylinders that received port injection just prior to engine stop. Air and fuel mixtures are combusted in cylinder numbers three and four according to the engine's order of combustion. Fuel injection resumes to cylinder numbers three and four after fuel injected during engine shutdown is inducted into cylinder numbers three and four. Cylinder numbers one and two transition to closed valve injection after a first combustion event in each of the respective cylinders as shown.

In this way, a portion of engine cylinders may be prepared for a subsequent engine restart after an engine stop. Further, fuel vaporization for cylinders having closed valves at the time of engine stop may be further improved via increasing fuel injection pressure during the engine stop. Cylinders that have open valves at the time of engine stop or within a predetermined number of crankshaft degrees after engine rotation may receive fuel injected while intake valves are open.

Referring now to FIG. 3, a second example engine stop and start according to the method of FIG. 4 is shown. The second example engine stop and start shows engine stopping and starting for an engine that is supplied fuel with a higher alcohol concentration. The operating sequence of FIG. 3 may be provided via the system of FIG. 1 executing instructions according to the method of FIG. 4 that are stored in non-transitory memory. Vertical markers T10-T12 represent times of particular interest during the sequence. All plots in FIG. 3 are referenced to the same X axis scale. The engine starting and stopping sequence is for a four cylinder four stroke engine having a firing order of 1-3-4-2.

The first through sixth plots of FIG. 3 are for the same variables described in FIG. 2. Therefore, for the sake of brevity, the description of each plot is omitted. The fuel injection, intake valve timing, and spark designations are also the same as described for FIG. 2.

At T10, the engine is rotating and combusting an air fuel mixture. The fuel injection pressure is a middle level pressure and the fuel provided to the engine has a higher alcohol concentration. Cylinder number one is entering an intake stroke, cylinder number three is entering an exhaust stroke, cylinder number four is entering an expansion stroke, and cylinder number two is entering a compression stroke.

Between T10 and T11, the engine continues to rotate and the cylinders progress through the indicated strokes. Fuel injection occurs in each cylinder is via a port fuel injector, and the timing for injecting fuel to each cylinder is before the intake valve of the cylinder receiving the fuel opens. Spark for the cylinder receiving fuel occurs during the compression stroke. In this example, the intake valve opening timing between T10 and T11 begins to open for each cylinder at top dead center intake stroke and closes after bottom dead center compression stroke.

At T11, a request to stop the engine is made (not shown). The request to stop the engine may be made via a driver operating a switch or via the controller determining conditions are desirable to automatically stop the engine. An engine stopping or shutdown procedure begins in response to the engine stop request.

Between T11 and T12 the engine is shutdown in response to the request to stop the engine. In particular, port injection of fuel to the cylinders is stopped for a first time before engine stop after the engine stop request and combustion in engine cylinders is ceased. For cylinders, such as cylinder number three, where port fuel injection has started, the fuel injection that is started is completed. Spark is also stopped after fuel injection is stopped. Spark is provided to cylinders that have inducted a last fuel amount before engine stop so that substantially all injected and inducted fuel (e.g., greater than 85%) is combusted in engine cylinders before engine stop. The engine continues to rotate and engine speed (not shown) is reduced via engine friction and pumping losses.

The fuel injection pressure is increased after fuel injection to engine cylinders is stopped a first time since the engine stop request. By increasing fuel injection pressure, vaporization of fuel with a higher alcohol concentration injected to closed intake valves near the engine stop position may be improved. In one example, a table or function includes empirically determined fuel injection pressures that are based on engine temperature and an amount of alcohol in the fuel supplied to the engine. The table outputs a desired fuel injection pressure and fuel pump output pressure is increased to the desired fuel injection pressure. In this example, the fuel injection pressure is increased to a level that is greater than the fuel injection pressure shown in FIG. 2 so that the alcohol in the fuel may exhibit improved vaporization.

Intake valve timing is advanced in response to the engine stop request and the alcohol content in the fuel injected to the engine. By advancing the intake valve closing time, fuel that is injected to closed intake valves may have an even longer period of time to vaporize.

Engine controller 12 of FIG. 1 also estimates engine stopping position before engine stop (e.g., between T11 and T12). Engine cylinders expected to have closed intake valves at the time the engine stops rotating are determined from the estimated engine stopping position and intake cam timing. In one example, intake valve closing times, or alternatively intake valve opening times, may be determined for each cylinder based on a table of empirically determined intake valve opening times and cam position relative to a base cam position.

Fuel is injected to intake ports of at least a portion of cylinders with pistons expected to stop when the cylinder's intake valves are closed. Fuel may be injected to an intake port of a cylinder having a piston expected to stop after intake valves of cylinder close for a last time before the expected engine stop. If the engine stops rotating before a desired amount of fuel is injected to a particular cylinder, the fuel injection may continue while the engine is stopped until the desired amount of fuel is injected.

In some examples such as the example shown in FIG. 3, fuel is injected to a predetermined number of engine cylinders having pistons expected to stop when the cylinder's intake valves are closed (e.g., half the number of engine cylinders). The remaining engine cylinders receive port injected fuel during intake strokes of the respective cylinders when intake valves are open, even if the engine stops with closed intake valves in more than half of the engine cylinders. Specifically, fuel injection is restarted after being stopped in cylinder number three. Fuel is injected to cylinder number three as the engine decelerates and while intake valves of cylinder number three are closed. The fuel injection to cylinder number three stops at T12. Fuel is injected to cylinder number four shortly after the intake valve of cylinder number four closes and before the engine stops at T12. Fuel is not injected to cylinder numbers one and two before the engine stops at T12. By injecting fuel to the ports of cylinder numbers three and four, the injected fuel has more time to vaporize so that it may be readily combusted during the subsequent engine restart. The fuel pressure remains at a higher level when the engine stops rotating at T12.

The engine may be stopped at T12 for seconds or longer depending on operating conditions. An engine restart (not shown) request is made while the engine is stopped at T12. The engine begins to rotate via a starter after the engine start request and fuel is injected to cylinder numbers two and one based on engine position and engine firing order. The fuel is injected to intake ports of cylinder numbers two and one while intake valves of cylinder numbers two and one are open. Thus, cylinder numbers two and one receive open valve port fuel injection such that the cylinders with earliest intake valve opening since engine stop are supplied open valve fuel injection. In one example, a predetermined number of engine cylinders that have earliest intake valve opening since engine start are supplied fuel injected during an open intake valve of the cylinder receiving the fuel. By supplying port injected fuel to open intake valves, the engine may start faster as cylinder numbers two and one are the first two cylinders to combust an air fuel mixture since engine stop at T12.

As the engine continues to rotate, fuel injected to intake ports of cylinder numbers three and four during engine shutdown is inducted and combusted without additional fuel injection to cylinder numbers three and four. However, if the engine stop time is greater than a threshold amount of time, additional fuel may be port injected to cylinders that received port injection just prior to engine stop. Air and fuel mixtures are combusted in cylinder numbers three and four according to the engine's order of combustion. Fuel injection resumes to cylinder numbers three and four after fuel injected during engine shutdown is inducted into cylinder numbers three and four. Cylinder numbers one and two transition to closed valve injection after a first combustion event in each of the respective cylinders as shown. Intake valve timing is retarded back to base intake valve timing.

In this way, a portion of engine cylinders may be prepared for a subsequent engine restart after an engine stop. Further, fuel vaporization for cylinders having closed valves at the time of engine stop may be further improved via increasing fuel injection pressure and advancing intake valve closing time during the engine stop. Cylinders that have open valves at the time of engine stop or within a predetermined number of crankshaft degrees after engine rotation may receive fuel injected while intake valves are open.

Referring now to FIG. 4, a method for operating an engine is shown. The method of FIG. 4 may be stored in non-transitory memory as executable instructions for a system as shown in FIG. 1. The method of FIG. 4 may provide the operating sequences shown in FIGS. 2 and 3.

At 402, method 400 determines alcohol content of fuel supplied to the engine and barometric pressure. Barometric pressure may be determined via a pressure sensor such as MAP sensor 122 of FIG. 1. Alternatively, barometric pressure may be determined via an engine air flow meter 120 shown in FIG. 1. Alcohol content of fuel may be determined via a fuel sensor or via a fuel injection variable that changes as a stoichiometric air-fuel ratio changes with alcohol content in fuel. Method 400 proceeds to 404 after alcohol content of fuel and barometric pressure are determined.

At 404, method 400 judges whether or not an engine stop request has been made. An engine stop request may be made via a driver or a controller. A driver may make an engine stop request via a push button or switch. A controller, such as controller 12 of FIG. 2, may make an engine stop request in response to vehicle operating conditions. For example, a controller may request an engine stop when vehicle speed is zero, vehicle brakes are applied, and when a driver demand torque is less than a threshold level. If method 400 judges that an engine stop request is present, method 400 proceeds to 406. Otherwise, method 400 exits.

At 406, method 400 ceases to inject fuel to cylinder intake ports and spark to cylinders. Fuel injection is stopped for engine cylinders where fuel is not being injected at the time of the engine stop request. Fuel injection is completed without interruption for engine cylinders where fuel is being injected at the time of the engine stop request. Spark is ceased for cylinders that have not inducted fuel at the time of the engine stop request. Spark is ceased for cylinders that have inducted fuel at the time of the engine stop request after the inducted fuel is combusted. In this way, combustion in engine cylinders is ceased in an orderly manner and the engine begins to decelerate in response to engine friction and pumping losses. Method 400 proceeds to 408 after combustion in engine cylinders is ceased.

At 408, method 400 estimates an engine stopping position. In one example, engine stopping position is estimated when engine speed is reduced to a threshold speed. Engine stopping position may be estimated based on the strokes of the respective cylinders at the time engine speed reaches the threshold speed. For example, a table or function with empirically determined engine stopping positions (e.g., crankshaft degrees relative to top dead center compression stroke cylinder number one) may be indexed via the stroke or crankshaft angle with respect to top dead center compression stroke cylinder number one at the time the engine reaches the threshold speed. The table or function then outputs an estimated engine stopping position. For example, the table or function may estimate the engine stopping position to be 90 crankshaft degrees after top dead center compression stroke of cylinder number one.

In other examples, engine stopping position may be estimated based on an engine friction model and engine position at a time when engine speed is reduced to a threshold speed. For example, the engine friction model estimates a number of engine crankshaft degrees from the time engine speed is reduced to the threshold speed until the engine stops rotating. The estimated number of crankshaft degrees are added to the engine position at the time the engine speed reaches the threshold speed to determine the estimated engine stopping position. Method 400 proceeds to 410 after engine stopping position is estimated.

At 410, method 400 selects a first group of engine cylinders from the total number of engine cylinders that are to receive closed valve fuel injection in preparation for an expected subsequent engine start. In one example, the first group of engine cylinders from the total number of engine cylinders is comprised of half the total number of engine cylinders. The identification of specific cylinders in the first group is based on engine stopping position, intake valve timing for the engine cylinders, and engine firing order.

For example, for a four cylinder four-stroke engine having a firing order of 1-3-4-2 that is expected to stop in the middle of an intake stroke of cylinder number two as shown in FIG. 2, the first group of engine cylinders is comprised of cylinder numbers three and two since cylinder numbers three and two have closed intake valves at the engine stop position. Further, cylinder numbers three and two are scheduled to receive port injected fuel because they are in a group of engine cylinders comprising half the total number of engine cylinders that combust an air-fuel mixture latest in a first engine cycle (e.g., two engine revolutions) since engine stop. Additionally, cylinder numbers three and two are the last cylinders to have intake valves close before engine stop and injection may be based on this condition as well. Of course, in other examples, the first group of engine cylinders scheduled to receive fuel injection during a time when fuel is injected to a cylinder port with a closed intake valve may be comprised of a number fewer or greater than half the total number of engine cylinders. Method 400 proceeds to 412 after engine cylinders in the first group of engine cylinders are selected.

At 412, method 400 selects a second group of engine cylinders for being provided fuel when intake valves of cylinders of the second group are open. In one example, the number of engine cylinders in the second group of cylinders is half the total number of engine cylinders. Further, the cylinders selected for the second group of engine cylinders begins with a cylinder that has open intake valves at engine stop and additional cylinders are added to the second group of engine cylinders based on engine firing order until half or an alternative number of the total number of engine cylinders are assigned to the second group of cylinders.

For example, in the above example where the engine stops at a location where the intake valve of cylinder number two is open and engine firing order is 1-3-4-2, cylinder number two is first selected for cylinder group number two and then cylinder number one is added to the second group of cylinders because it is next in the engine firing order. Assignment of cylinders to cylinder group number two ends after cylinder number one is added to cylinder group number two because half the total number of engine cylinders are assigned to the second group of engine cylinders. Of course, similar assignments to the second group of cylinders may be made at other engine stopping positions and for engines having fewer or additional cylinders. Method 400 proceeds to 414 after cylinders are assigned to the second group of cylinders.

At 414, method 400 adjusts fuel injection pressure in response to the engine stop request and alcohol content in the fuel being delivered to the engine. In one example, a table or function including empirically determined fuel pressures that enhance fuel vaporization is indexed based on the alcohol concentration in fuel supplied to the engine. The table or function outputs a desired fuel pressure and fuel pump pressure is increased to the desired fuel pressure. In one example, desired fuel pressure is increased as alcohol concentration in the fuel increases, and desired fuel pressure after the engine stop request is greater than desired fuel pressure before the engine stop request. Method 400 proceeds to 416 after fuel pressure is adjusted.

At 416, method 400 advances intake valve timing in response to the engine stop request and alcohol content in the fuel being delivered to the engine. In one example, a table or function including empirically determined intake valve timings is indexed based on the alcohol concentration in fuel supplied to the engine. The table or function outputs a desired intake valve timing and intake valve timing is advanced to the desired intake valve timing. In one example, desired intake valve timing is advanced as alcohol concentration in the fuel increases. Method 400 proceeds to 418 after intake valve timing is advanced.

At 418, method 400 injects fuel to intake ports of cylinders in the first group of cylinders. Method 400 injects fuel to the intake ports of cylinders in the first group of cylinders before the engine is stopped and after intake valves in the first group of cylinders close a last time before engine stop.

For example, in the above mentioned example where the engine is forecast to stop at a position where cylinder number two is on an intake stroke with intake valves open, fuel is injected to cylinder number three after the intake valve of cylinder number three closes a last time before engine stop. Likewise, fuel is injected to cylinder number four after the intake valve of cylinder number four closes a last time before engine stop. FIG. 2 shows such an example.

The amount of fuel injected to each cylinder in the first group of cylinders may be varied based on the order of combustion in engine cylinders after engine stop during an engine start. Further, the amount of fuel injected to each cylinder may be varied based on an expected manifold pressure during a first induction event in the cylinder receiving fuel during engine run-up from cranking speed to idle speed. Thus, cylinders firing closer to the engine stop for a first time since engine stop receive a greater amount of fuel before engine stop than cylinders firing for a first time since engine stop farther in time from engine stop. Additionally, the amount of fuel injected is varied based on barometric pressure, and the scheduled amount of fuel to be injected is injected even if the engine stops before all fuel is injected. The start of injection timing is advanced as intake valve timing is advanced so that the amount of time the fuel encounters the intake valve may be increased. Method 400 proceeds to 420 after fuel injection during closed valve timing to the first group of engine cylinders commences.

At 420, method 400 stops the engine. The engine is stopped because combustion is stopped in engine cylinders via ceasing fuel flow and spark. Also, fuel supplied to the engine at 418 does not participate in combustion before engine restart or enter engine cylinders, with exception of leakage through intake valves, before engine restart. Method 400 proceeds to 422 after engine stop.

At 422, method 400 judges whether or not an engine start request is present. An engine start request may be initiated via a driver operating a push button or switch. Alternatively, an engine start request may be made by a controller responding to vehicle conditions. For example, an engine start request may be made in response to a driver releasing a brake pedal. If an engine start request is present, the answer is yes and method 400 proceeds to 424. Otherwise, the answer is no and method 400 returns to 422.

At 424, method 400 begins cranking the engine via the starter and supplying fuel to cylinders in the second group of cylinders as intake valves in cylinders of the second group of cylinders open. Fuel is injected to each cylinder of the second group of cylinders as the intake valve of the cylinder receiving fuel opens. For example, as shown in FIG. 2, a first fuel injection since engine stop is provided to cylinder number two since the engine stopped at a position where the intake valve of cylinder number two is open. The next fuel injection is supplied to cylinder number one when the intake valve of cylinder number one opens.

The controller does not supply fuel to cylinders of the first group of cylinders for the first engine cycle since engine stop since the first group of cylinders received fuel before engine stop. However, if the engine stop is longer than a threshold amount of time, additional fuel may be supplied to the first group of cylinders during the first engine cycle since engine stop. In this way, fuel injected to cylinders in the first group of cylinders may vaporize more completely than if fuel were injected during the first engine cycle since engine stop. Method 400 proceeds to 428 after fuel injection begins.

At 428, method 400 retards intake valve timing back to base intake valve timing. However, if the intake valve timing may be adjusted during the time the engine is stopped, intake valve timing is adjusted during the engine stop period. Additionally, fuel injected to all engine cylinders is transitioned to closed valve injection after the first engine cycle. Method 400 proceeds to exit after intake valve timing is adjusted.

Thus, the method of FIG. 4 provides for operating an engine, comprising: ceasing combustion in engine cylinders; port injecting fuel to a first cylinder while the engine is rotating and intake valves of the first cylinder are closed; stopping the engine without inducting the port injected fuel into the first cylinder; and combusting the port injected fuel in the first cylinder after port injecting fuel to a second cylinder while intake valves of the second cylinder are open. The method includes where port injected fuel to the first cylinder is combusted after port injected fuel to the second cylinder is combusted. The method includes where the engine is stopped without opening the intake valves of the first cylinder and after port injecting fuel to the first cylinder. The method includes where the first cylinder is one cylinder of a first group of cylinders and where the second cylinder is one cylinder of a second group of cylinders, and where fuel is injected to each cylinder of the second group of cylinders while intake valves of each cylinder receiving fuel are open during an engine start.

In some examples, the method includes where the first cylinder is one cylinder of a first group of cylinders and where the second cylinder is one cylinder of a second group of cylinders, and where fuel is injected to each cylinder of the first group of cylinders while intake valves of each cylinder receiving fuel is closed during an engine stop. The method includes where fuel injected to each cylinder of the first group of cylinders during the engine stop is not combusted until an engine start. The method further comprises adjusting start of fuel injection time during engine stopping in response to an alcohol content of fuel being injected to the engine.

The method of FIG. 4 also provides for operating an engine, comprising: advancing intake valve timing during an engine stop; advancing injection starting time and port injecting fuel to a first cylinder responsive to intake valve timing advance; stopping the engine without inducting the port injected fuel into the first cylinder; and combusting the port injected fuel in the first cylinder after port injecting fuel to a second cylinder while intake valves of the second cylinder are open. The method includes where advancing injection starting time of port injected fuel to the first cylinder occurs while the engine is rotating.

In some examples, the method includes where the port injected fuel to the second cylinder is combusted before the port injected fuel to the first cylinder. The method includes where intake valve timing is advanced in response to an alcohol concentration of fuel supplied to the engine. The method further comprises increasing fuel injection pressure during the engine stop in response to the alcohol concentration of the fuel supplied to the engine. The method includes where the first cylinder is one cylinder of half of the engine's cylinders, and where each cylinder of the half of the engine's cylinders receive fuel during a closed intake valve event of a cylinder receiving fuel. The method further comprises estimating a stopping position of the engine and port injecting fuel to the first cylinder based on the estimated stopping position.

As will be appreciated by one of ordinary skill in the art, method described in FIG. 4 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for operating an engine, comprising:

ceasing combustion in engine cylinders;

cranking the engine;

port injecting fuel to a first cylinder while the engine is rotating and intake valves of the first cylinder are closed;

stopping the engine without inducting the port injected fuel into the first cylinder; and combusting the port injected fuel in the first cylinder after port injecting fuel to a second cylinder while intake valves of the second cylinder are open, where port injected fuel to the first cylinder is combusted after port injected fuel to the second cylinder is combusted.

2. The method of claim 1, where the engine is stopped without opening the intake valves of the first cylinder and after port injecting fuel to the first cylinder.

3. The method of claim 1, where the first cylinder is one cylinder of a first group of cylinders and where the second cylinder is one cylinder of a second group of cylinders, and where fuel is injected to each cylinder of the second group of cylinders while intake valves of each cylinder receiving fuel are open during an engine start.

4. The method of claim 1, where the first cylinder is one cylinder of a first group of cylinders and where the second cylinder is one cylinder of a second group of cylinders, and where fuel is injected to each cylinder of the first group of cylinders while intake valves of each cylinder receiving fuel are closed during an engine stop.

5. The method of claim 4, where fuel injected to each cylinder of the first group of cylinders during the engine stop is not combusted until an engine start.

6. The method of claim 1, further comprising adjusting start of fuel injection time during engine stopping in response to an alcohol content of fuel being injected to the engine.

7. A method for operating an engine, comprising:

advancing intake valve timing during an engine stop;

advancing injection starting time and port injecting fuel to a first cylinder responsive to intake valve timing advance;

stopping the engine without inducting the port injected fuel into the first cylinder;

cranking the engine; and combusting the port injected fuel in the first cylinder after port injecting fuel to a second cylinder while intake valves of the second cylinder are open, where the port injected fuel to the second cylinder is combusted before the port injected fuel to the first cylinder.

8. The method of claim 7, where advancing injection starting time of port injected fuel to the first cylinder occurs while the engine is rotating.

9. The method of claim 7, where intake valve timing is advanced in response to an alcohol concentration of fuel supplied to the engine.

10. The method of claim 9, further comprising increasing fuel injection pressure during the engine stop in response to the alcohol concentration of the fuel supplied to the engine.

11. The method of claim 7, where the first cylinder is one cylinder of half of the engine's cylinders, and where each cylinder of the half of the engine's cylinders receive fuel during a closed intake valve event of a cylinder receiving fuel.

12. The method of claim 7, further comprising estimating a stopping position of the engine and port injecting fuel to the first cylinder based on the estimated stopping position.

13. A vehicle system, comprising:

an engine including first and second groups of cylinders and an adjustable intake valve system; and a controller including non-transitory instructions executable to cease combustion in the first and second groups of cylinders during an engine stop, port injecting fuel to closed intake valves of the first cylinder group before the engine stop without inducting the port injected fuel into the first group of cylinders, and to crank the engine and perform a first combustion event in a cylinder of the second cylinder group in response to an engine start, where fuel is port injected to open intake valves of the second cylinder group, and where the port injected fuel to the second cylinder group is combusted before the port injected fuel to the first cylinder.

14. The vehicle system of claim 13, further comprising additional instructions executable to increase fuel pressure in response to a request to stop the engine.

15. The vehicle system of claim 14, further comprising additional instructions executable to increase fuel pressure in response to an alcohol content of fuel supplied to the engine.

16. The vehicle system of claim 13, further comprising additional instructions to advance intake valve timing in response to a request to stop the engine.

17. The vehicle system of claim 13, where the first group of cylinders is one half a total number of engine cylinders.

18. The vehicle system of claim 13, further comprising additional instructions to estimate an engine stopping position.

* * * * *